US011367949B2

(12) United States Patent
Mannan

(10) Patent No.: US 11,367,949 B2
(45) Date of Patent: Jun. 21, 2022

(54) ANTENNA

(71) Applicant: Michael Mannan, Harrow (GB)

(72) Inventor: Michael Mannan, Harrow (GB)

( * ) Notice: Subject to any disclaimer, the term of this patent is extended or adjusted under 35 U.S.C. 154(b) by 43 days.

(21) Appl. No.: 17/055,373

(22) PCT Filed: May 7, 2019

(86) PCT No.: PCT/GB2019/051249
§ 371 (c)(1),
(2) Date: Nov. 13, 2020

(87) PCT Pub. No.: WO2019/220078
PCT Pub. Date: Nov. 21, 2019

(65) Prior Publication Data

US 2021/0226324 A1 Jul. 22, 2021

(30) Foreign Application Priority Data

May 15, 2018 (GB) ..... 1807833
Feb. 12, 2019 (GB) ..... 1901912

(51) Int. Cl.
*H01Q 1/32* (2006.01)
*H01Q 9/04* (2006.01)
*H01Q 9/28* (2006.01)
*H01Q 19/10* (2006.01)

(52) U.S. Cl.
CPC ..... *H01Q 1/3266* (2013.01); *H01Q 1/3283* (2013.01); *H01Q 9/0407* (2013.01); *H01Q 9/285* (2013.01); *H01Q 19/108* (2013.01)

(58) Field of Classification Search
CPC ..... H01Q 1/32; H01Q 1/3266; H01Q 1/3283; H01Q 1/38; H01Q 9/0407; H01Q 9/285; H01Q 19/108
See application file for complete search history.

(56) References Cited

U.S. PATENT DOCUMENTS 5,122,809 A * 6/1992 Haruyama ..... H01Q 9/285 343/797
5,400,039 A 3/1995 Araki et al.
5,634,209 A 5/1997 Prudhomme et al.
5,943,025 A 8/1999 Benham et al.
6,057,802 A * 5/2000 Nealy ..... H01Q 21/245 343/873
6,091,365 A 7/2000 Derneryd et al.
(Continued)

FOREIGN PATENT DOCUMENTS

CN 104241826 A 12/2014
CN 204011731 U 12/2014
(Continued)

OTHER PUBLICATIONS

International Search Report (Form PCT/ISA/210) for International Application No. PCT/GB2019/051249 dated Jul. 18, 2019, 3 pages.
(Continued)

*Primary Examiner* — Daniel Munoz
(74) *Attorney, Agent, or Firm* — Withrow & Terranova, P.L.L.C.; Vincent K. Gustafson

(57) ABSTRACT

An antenna with at least one pair of electrically conducting lands, and a second pair of spaced-apart electrically conducting lands or a single land, wherein the lands are parallel with respect to a first electrically conductive sheet is disclosed.

20 Claims, 4 Drawing Sheets

(56) References Cited

U.S. PATENT DOCUMENTS

| | | | |
|---|---|---|---|
| 6,160,514 | A | 12/2000 | Judd |
| 6,326,932 | B1 | 12/2001 | Mannan |
| 2002/0171588 | A1 | 11/2002 | Fang |
| 2003/0197646 | A1 | 10/2003 | Tran |
| 2003/0210207 | A1 | 11/2003 | Suh et al. |
| 2005/0235482 | A1 | 10/2005 | Deaett et al. |
| 2006/0035588 | A1 | 2/2006 | Chapelle |
| 2011/0102269 | A1 | 5/2011 | Sato et al. |
| 2012/0176289 | A1 | 7/2012 | Lee |
| 2015/0295316 | A1 | 10/2015 | Mannan |
| 2016/0087327 | A1 | 3/2016 | Niihara et al. |

FOREIGN PATENT DOCUMENTS

| | | | |
|---|---|---|---|
| CN | 204375948 | U | 6/2015 |
| CN | 104769770 | A | 7/2015 |
| DE | 60100376 | T2 | 4/2004 |
| EP | 0698972 | A1 | 2/1996 |
| EP | 0720252 | A1 | 7/1996 |
| EP | 1768211 | A1 | 3/2007 |
| GB | 2253108 | A | 8/1992 |
| GB | 2384368 | A | 7/2003 |
| GB | 2392563 | A | 3/2004 |
| GB | 2505495 | A | 3/2014 |
| GB | 2513334 | A | 10/2014 |
| GB | 2544558 | A | 5/2017 |
| JP | 2001-085921 | A | 3/2001 |
| JP | 2007-060386 | A | 3/2007 |
| JP | 2008-306238 | A | 12/2008 |
| JP | 2009-194844 | A | 8/2009 |
| WO | 9602074 | A1 | 1/1996 |
| WO | 9738463 | A1 | 10/1997 |
| WO | 0159881 | A1 | 8/2001 |
| WO | 0184730 | A1 | 11/2001 |
| WO | 0231908 | A2 | 4/2002 |
| WO | 0233786 | A1 | 4/2002 |
| WO | 2004021510 | A1 | 3/2004 |

OTHER PUBLICATIONS

Written Opinion (Form PCT/ISA/237) for International Application No. PCT/GB2019/051249 dated Jul. 18, 2019, 7 pages.
Combined Search and Examination Report under Sections 17 & 18(3) for United Kingdom Patent Application No. GB1520640.2 dated Apr. 21, 2016, 10 pages.
Ahmad Hoorfar, "Analysis of a 'Yagi-like' printed stacked dipole array for high-gain applications," Microwave and Optical Technology Letters, vol. 17, No. 5, Dec. 7, 1998, pp. 317-321.
Combined Search and Examination Report under Sections 17 & 18(3) for United Kingdom Patent Application No. GB1901912.4 dated Jul. 17, 2019, 5 pages.
European Examination Report for European Patent Application No. 13774471.0 dated Apr. 9, 2018, 10 pages.
Office Action for Chinese Patent Application No. 201380045823.X dated Jun. 7, 2016, 12 pages.
Search Report for Chinese Patent Application No. 201380045823.X dated May 23, 2016, 2 pages.
Office Action for Chinese Patent Application No. 201380045823.X dated Feb. 7, 2017, 11 pages.
Office Action for Chinese Patent Application No. 201380045823.X dated Sep. 22, 2017, 5 pages.
Search Report under Section 17 for United Kingdom Patent Application No. GB1215618.8 dated Jul. 26, 2013, 2 pages.
Examination Report under sections 12 & 13 of the Patents Act, 1970 and the Patents Rules, 2003 for India Patent Application No. 2604/DELNP/2015 dated Jan. 22, 2020, 7 pages.
Office Action for Japanese Patent Application No. 2015-529128 dated Sep. 26, 2017, 12 pages.
Office Action for Mexico Patent Application No. MX/a/2015/002//3, date unavailable, 4 pages.
International Preliminary Report on Patentability (Form PCT/IB/373) for International Application No. PCT/GB2013/052305 dated Mar. 3, 2015, 10 pages.
International Search Report (Form PCT/ISA/210) for International Patent Application No. PCT/GB2013/052305 dated Dec. 9, 2013, 4 pages.
Office Action for U.S. Appl. No. 14/425,309 dated Jul. 6, 2016, 12 pages.
Office Action for Chinese Patent Application No. 201680067638.4 dated Jul. 23, 2020, 3 pages.
Search Report for Chinese Patent Application No. 201680067638.4 dated Jul. 15, 2020, 2 pages.
Examination Report for European Patent Application No. 16825870.5 dated Oct. 31, 2019, 6 pages.
Examination Report for European Patent Application No. 16825870.5 dated Oct. 6, 2020, 6 pages.
International Search Report (Form PCT/ISA/210) for International Patent Application No. PCT/GB2016/053632 dated Apr. 11, 2017, 14 pages.

* cited by examiner

*FIG.* 4
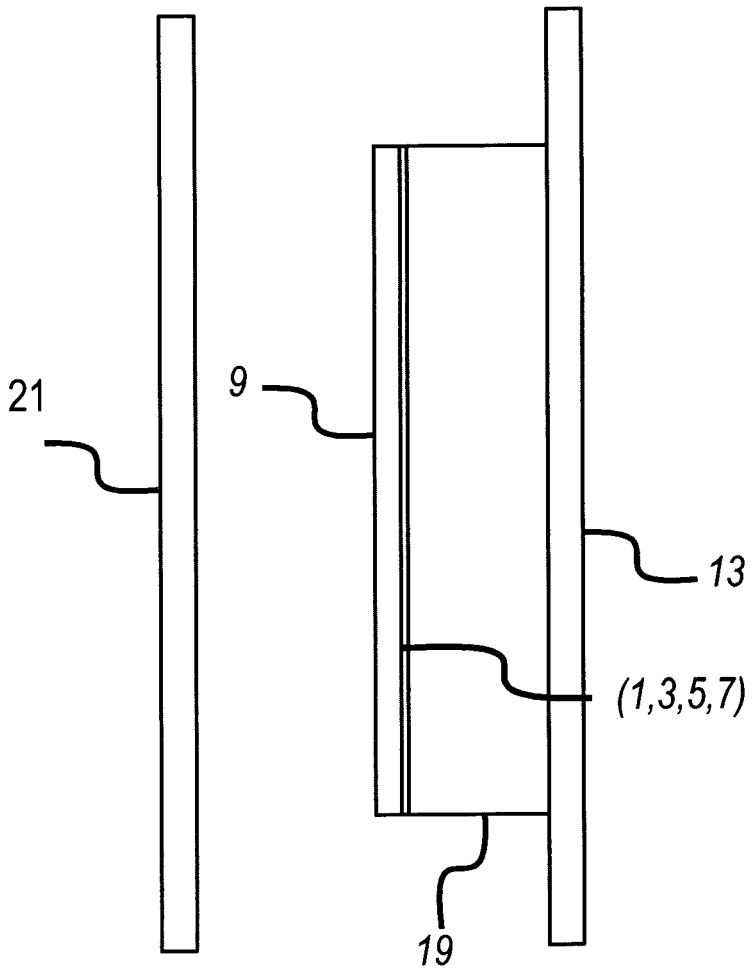

ANTENNA

This application is a 35 U.S.C. § 371 national phase filing of International Application No. PCT/GB2019/051249 filed on May 7, 2019, and claims the benefit of United Kingdom Patent Application No. 1901912.4 filed on Feb. 12, 2019 and of United Kingdom Patent Application No. 1807833.7 filed on May 15, 2018, wherein the disclosures of the foregoing applications are hereby incorporated by reference herein in their respective entireties.

FIELD OF INVENTION

This invention relates to antennae. In one form it relates to an antenna which is particularly suited for, but not limited to integration in an automobile. The antenna can be used to boost the signal strength of radio signals used in certain frequency bands. The antenna may, for example, find particular application for receiving/transmitting GSM or Wi-Fi signals or for receiving terrestrial television signals.

BACKGROUND OF INVENTION

In recent years, the growth in consumer electronics has been significant. Such consumer electronics includes, but is not limited to televisions, monitors, mobile telephones, smartphones, tablet computers, laptops, personal computers, portable games consoles, smartwatches and smart devices. As these devices become more prevalent in everyday left, there is a need for these devices to be capable of radio reception, but it for connection to the internet, another device, or merely to receive information. This need coupled with the trend to miniaturize these devices, be it for aesthetic and/or portability reasons, means that a wireless connection is the only viable option.

The conventional approach with most of these devices is to miniaturize the relevant receiving/transmitting antennae. The antennae are miniaturised to the extent possible whilst still enabling acceptable performance. However, what would pass as acceptable performance in ideal conditions can rapidly degenerate into unacceptable performance in real world use. For example, intermediate objects, neighbouring devices, signals, and antennae can mean that the strength of the received signal is poor at best, and the low performance of the antenna does little to improve the situation. This can result in dropped packets when the antenna is used for connection to the internet. In low bandwidth applications, this may not be noticed, but with the emergence of high-bandwidth applications (e.g. 720p, 1080p, Ultra HD television, game streaming services, etc.), a reliable, stable connection is necessary.

It is also common for these devices to have built-in cellular capability, where they connect directly to a base station of a cellular network. It is known that such devices can permit "tethering" to provide cellular-based WAN access (i.e. the internet) to a tethered device that would otherwise not be available. For example, many automobile systems (e.g. navigation software, voice queries) rely on the presence of a smartphone for internet access. However, a smartphone in an automobile may suffer severe cellular signal loss due to movement of the automobile and/or weak cellular signal strength.

An alternative solution is to use a dedicated antenna on the automobile itself to make the long-range connection to the cellular network. Typically, the dedicated antenna has much better performance characteristics than those of the existing antennae used in consumer devices. The superior performance characteristics of the dedicated antenna can alleviate the efforts of cellular signal loss.

Clearly, the choice of the dedicated antenna to be used cannot be made independently of the environment in which it is employed. For example, a dedicated antenna with a large "footprint" cannot easily be integrated into an automobile. Conversely, reducing the footprint of the dedicated antenna to assist with integration could only serve to frustrate the superior performance characteristics for which the dedicated antenna exists.

Hence, there is a need for an antenna that has high gain, low directional preference, but is low profile so that it can be used in a variety of environments.

According to the present invention there is provided an antenna comprising: a pair of electrically conducting first lands disposed in a first plane, the first lands being arranged to either side of, and spaced-apart from, an imaginary line on the first plane; antenna feed means for the pair of first electrically conducting lands; a pair of spaced-apart electrically conducting second lands, or a single second land, disposed in said first plane, said pair of second lands, or said single second land, being spaced-apart from the pair of first lands along said imaginary line, being electrically-insulated from the pair of first lands, and the pair of second lands being arranged to either side of, or the single second land extending across, said imaginary line; and a third conducting land oriented in a second plane substantially parallel to the first plane, wherein the first plane is spaced apart from the second plane by a value in the range of between $9\lambda/100$ and $13\lambda/100$ for an antenna operating frequency of between 700 MHz to 1100 MHz, or in the range of $14\lambda/100$ to $18\lambda/100$ for an antenna operating frequency of between 470 MHz and 800 MHz, where A is the wavelength of operation of the antenna.

The antenna in accordance with the invention offers two modes of operation in opposite boresight directions respectively. It can, dependent on the boresight direction, provide either lower gain over a wider bandwidth, or higher gain over a narrower bandwidth.

Preferably, the pair of first lands are arranged symmetrically about the imaginary line and/or the pair of second lands are arranged symmetrically about said imaginary line, or said single second land is symmetrical about said imaginary line.

Where the antenna is intended to operate at frequencies between 700 MHz and 1.1 GHz, the first plane is preferably spaced from the second plane by between 3 cm and 4.3 cm and more preferably 4 cm.

For operation in the above frequency range, the first and second lands are preferably arranged in a substantially rectangular configuration in the first plane, with the imaginary line extending in a y-direction in the first plane, wherein the distance between the outer edges of the pair of first lands in an x-direction in the first plane, perpendicular to the y-direction, is between 8 cm and 9 cm and more preferably 8.5 cm, with a gap between the each of the first lands in the x-direction of between 0.5 cm and 1 cm and more preferably, 0.75 cm.

The overall distance between opposite outer edges of the pair of first lands and the pair of second lands, or between opposite outer edges the first lands and the single second land, is preferably between 8 cm and 10 cm in the y-direction and more preferably, 9 cm, with a gap between the first lands and the second lands, or the single second land, of between 1 cm and 3 cm in the y-direction and more preferably 2 cm.

Alternatively, where the antenna is intended to operate at frequencies between 470 MHz and 800 MHz, the first plane is preferably spaced from the second plane by between 6.9 cm and 8.8 cm and more preferably by 8 cm.

Here, the first and second lands are preferably arranged in a substantially rectangular configuration in the first plane, with the imaginary line extending in a y-direction in the first plane, wherein the overall distance between the outer edges of the pair of first lands in an x-direction in the first plane, perpendicular to the y-direction is between 16 cm and 19 cm and more preferably 17 cm.

A gap between the first lands in the x-direction is preferably between 0.5 cm and 2 cm and more preferably 1 cm. The overall distance between opposite outer edges of the pair of first lands and the pair of second lands, or the single second land, is preferably between 16 cm and 18 cm in the y-direction and more preferably is 17 cm.

A gap between the first lands and the second lands, or between the first lands and the single second land, is preferably between 3 cm and 5 cm in the y-direction and more preferably is 4 cm.

The antenna, irrespective of which of the above mentioned frequency ranges the antenna is to operate at, may further comprising a fourth conducting land in a third plane substantially parallel to both the first plane and the second plane, offset from both first plane and the second plane, with the first plane located between the third and second planes, with the third plane preferably spaced apart from the first plane by a distance substantially equal to that by which the first plane is spaced from the second plane. The antenna may then provide an even higher gain over a narrower bandwidth Where the antenna comprises a pair of second lands, preferably all of the first and second lands are substantially the same size and shape or have shapes which are mirror images of one another.

Where the antenna comprises a pair of second lands, preferably each land of the first and second lands is of a size and shape and has a spacing with respect to the other lands so as to permit resonance at the operating frequency.

Each land is preferably generally rectangular or trapezoidal, which allows the antenna to be easily scaled to a frequency of operation.

The third and/or fourth conducting land may comprise an electrically conducting panel of a device or of an object in which the antenna is mounted.

Where the antenna is mounted in an automobile, the panel may be a body part or a panel of the automobile and more particularly may be part of a wing mirror. Here, an outer surface or a backing of a mirror of the wing mirror may serve as the third land, with the first and second lands mounted within the wing mirror.

Alternatively the body part may comprise a panel of a metal door of an automobile or other object. Here the outer surface of the door may serve as the third land, with the first and second lands mounted within the door.

The third and/or fourth lands, and/or at least one of the first lands and/or the second land may be connected to an antenna ground and/or a system ground.

One or more of the second, third and/or fourth conducting lands, and/or one of the first lands may be connected to an antenna ground and/or a system ground. This can further improve the gain of the antenna.

BRIEF DESCRIPTION OF DRAWINGS

FIG. 4 shows an alternative antenna to that of FIG. 2.

Figure 1:
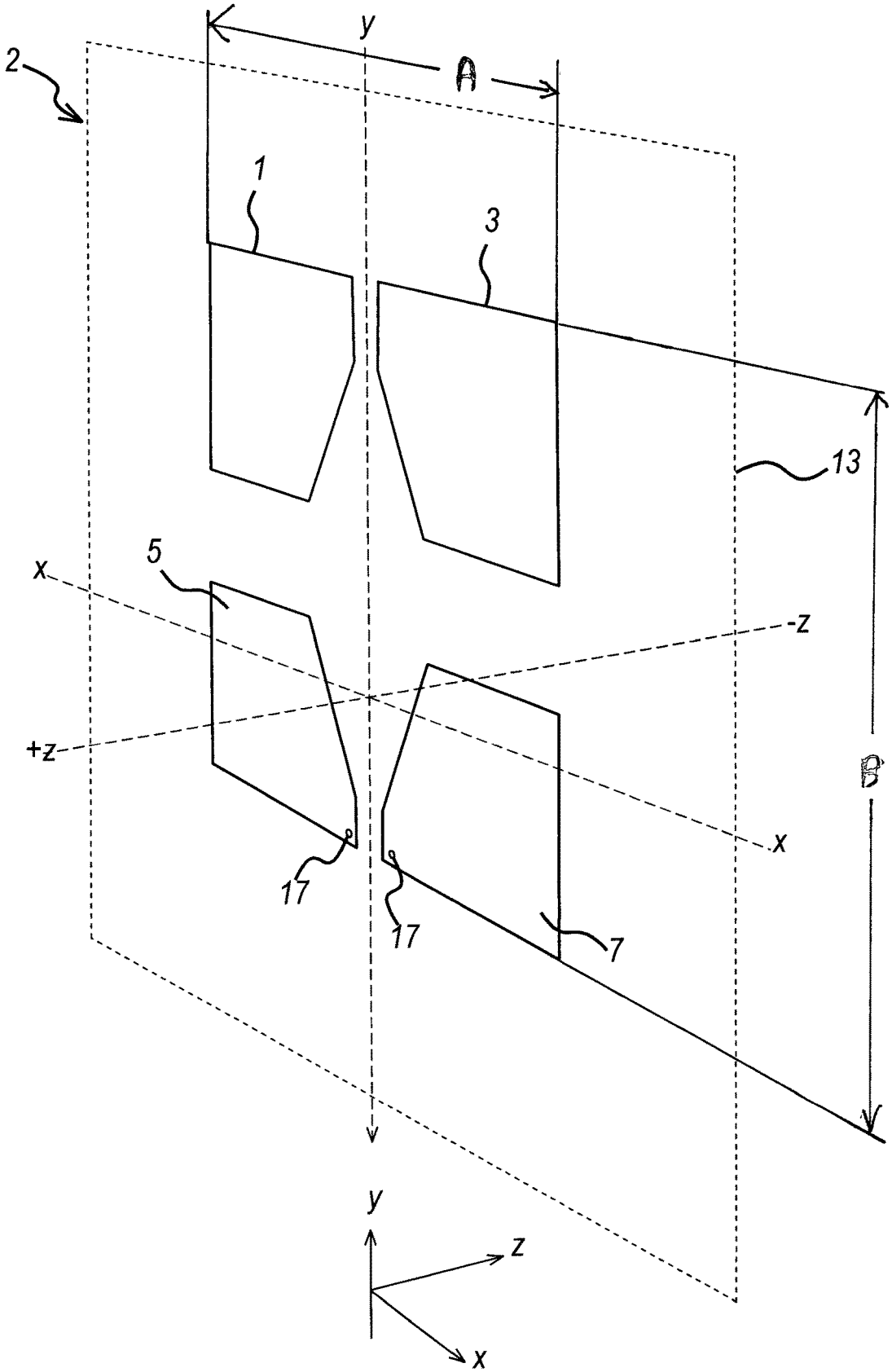
FIG. 1 shows an array which is used in conjunction with a first electrically conductive sheet of material to form an antenna.
Figure 2A:
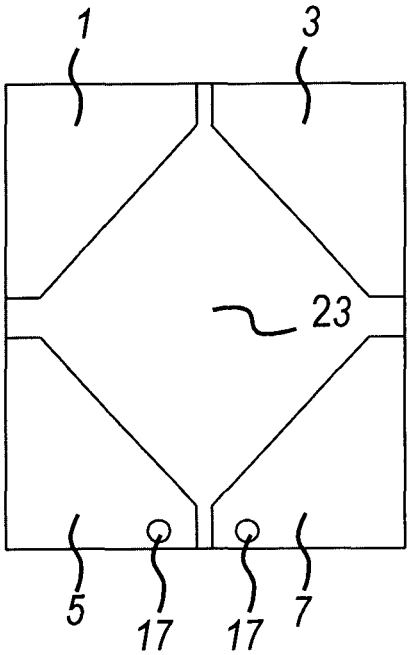
FIGS. 2(*a*), (*b*), (*c*) show XY elevations of the antenna of FIG. 1, and FIG. 2(*d*) shows a YZ elevation of the antenna of FIG. 1.
Figure 2B:
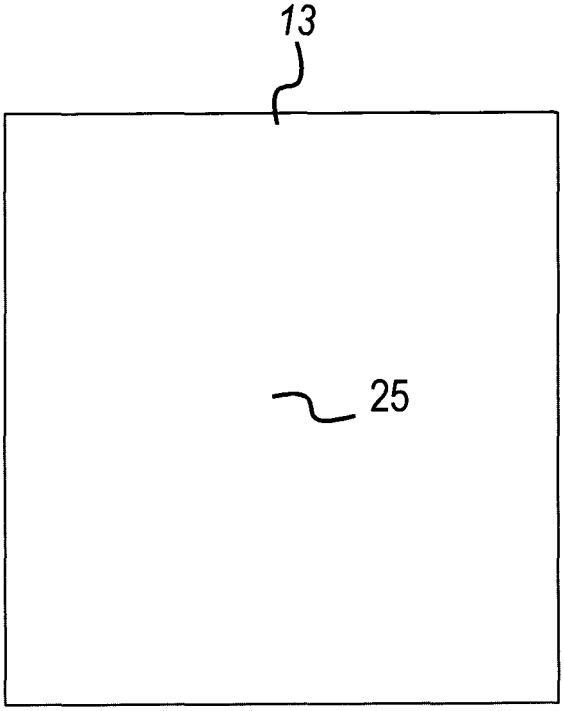
Figure 2C:
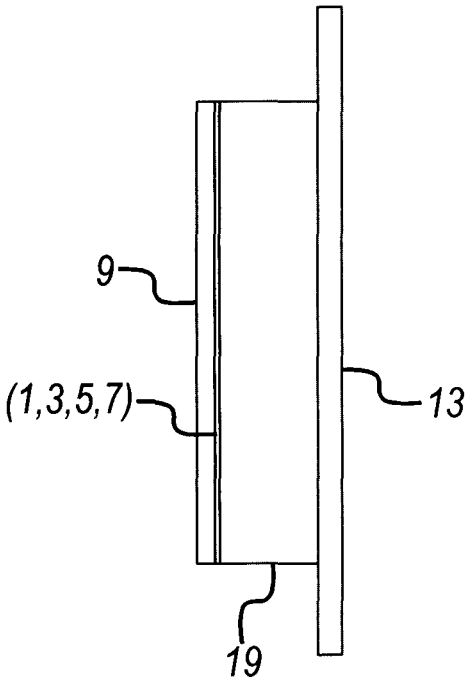
Figure 2D:
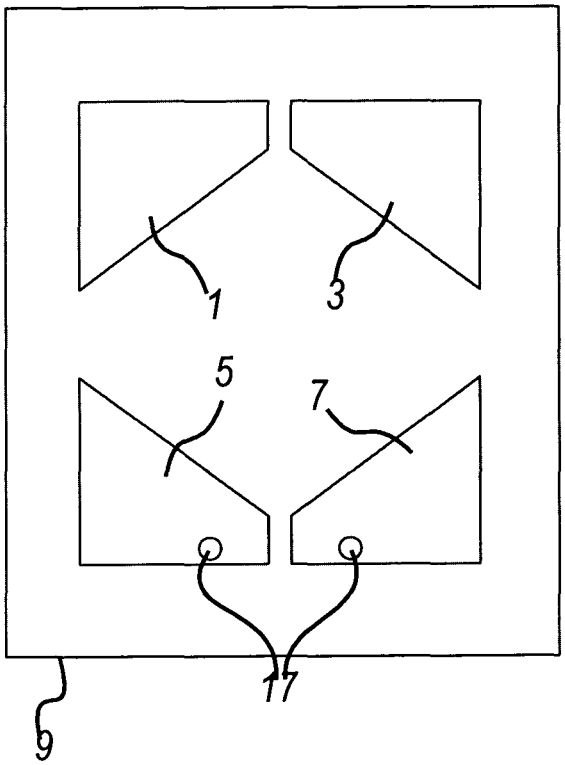

The antenna shown in FIG. 1 is intended to be used with GSM and/or Wi-Fi signals in the range of 700 MHz to 1.1 GHz and the antenna shown is optimised for signals of 900 MHz, towards the centre of this range.

As shown in FIGS. 1, 2(*a*) and 2(*d*), the antenna 2 comprises four spaced lands 1, 3, 5 and 7 in the XY plane (i.e. a first plane). Lands 5, 7 define a pair of first lands and the lands 1 and 3 define a pair of second lands. Lands 1, 3, 5 and 7, as shown, may have a fully or partially tapered edge from the y side to the x side (i.e. an edge which is at an angle in both the x and y directions). The lands 1, 3, 5 and 7 may be aluminium foil 1, 3, 5 and 7. The aluminium foil is approximately $200\times10^{-10}$ meters in thickness, which gives an electrical resistance of about 1.5 ohms per square. The lands may be supported by a sheet 9 of stiff cardboard (to which the lands have been laminated by hot foil blocking). The foil may be overcoated with an electrically-insulating lacquer. The arrangement may be manufactured by sputtering aluminium to the desired thickness onto a lacquer-coated backing surface. The aluminium is then coated with adhesive and the combination hot foil blocked onto the sheet 9 (shown in FIG. 2(*c*)) with the adhesive adjacent the sheet. The backing surface is peeled away to leave the sheet 9, lands 1, 3, 5, and 7 and lacquer overcoating bonded together.

Alternatively, as opposed to using a sheet 9, the lands may be supported by a device in which the antenna 2 is used.

A feed 17 is taken from the pair of first lands 5 and 7 for obtaining a signal at a desired frequency.

Each of the pair of lands 1, 3 and 5, 7 respectively is spaced apart from and is symmetrical about an imaginary line y-y on the XY plane.

Where the antenna is to be used for frequencies in the range of 700 MHz to 1.1 GHz, the spacing between the lands 1 and 3 and the lands 5 and 7 respectively will typically be between 0.5 cm and 1 cm and more particularly 0.7 cm. Each of the lands 1, 3, 5 and 7 will typically have a maximum width in the x-direction of between 3.5 cm and 4.4 cm and, in the example shown, each has a maximum width in the x-direction of 3.9 cm.

The pairs of lands 1, 5 and 3, 7 respectively are separated by a gap in the y-direction of between 1.5 cm and 2.5 cm and, in the example shown, this gap is 2 cm. Each of the lands 1, 3, 5 and 7 has a height in the y-direction of between 3 cm and 4 cm and, in the example shown, the height in the y-direction of 3.5 cm. Thus, the overall width "A" of the rectangle defined by the four lands 1, 3, 5 and 7 is 8.5 cm and the height "B" is 9 cm, providing a very compact footprint.

Although expression such as "width" and "height" are used above, this is used for assistance only when referring to the antenna as shown in the drawings, for antenna, in use, may have a different orientation to that shown.

With references to FIGS. 1, 2(*c*), and 2(*d*), the antenna also comprises a first electrically conductive sheet material 13, i.e. a third land. As shown in FIG. 2, the first electrically conductive sheet of material 13 is in a second plane parallel to the first plane and the lands 1, 3, 5 and 7, but spaced apart from lands 1, 3, 5 and 7. In this aspect, the spacing between the planes can be from about $9\lambda/100$ to $13\lambda/100$, where $\lambda$ is the wavelength of the frequency of operation of the antenna. For frequency bands centred on 900 MHz, $\lambda$ will be 33 cm and thus the gap may be in the range of 3 cm to 4.3 cm and, in the example shown, the gap is 4 cm. A centre 25 of the first electrically conductive sheet may align with a centre point 23 between the four lands 1, 3, 5, 7 on the first plane. The spacing between the third land 13 and the lands 1, 3, 5, 7 on the first plane, may comprise an insulator to tune the frequency of operation, or other antenna characteristics.

It will be appreciated that the size and/or shape of the lands can be varied according to the frequency of operation. For example, the configuration of the tapered edge can be varied to optimise performance. Other configurations include substantially square or trapezoidal.

Figure 3:
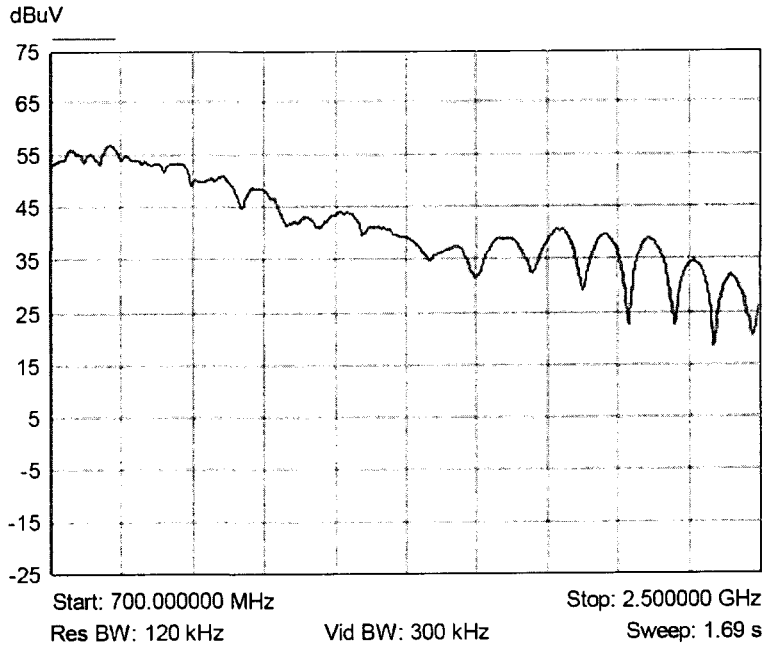
FIGS. 3(*a*) & (*b*) show the gain of the antenna of FIG. 1 at 900 MHz.
Figure 3:
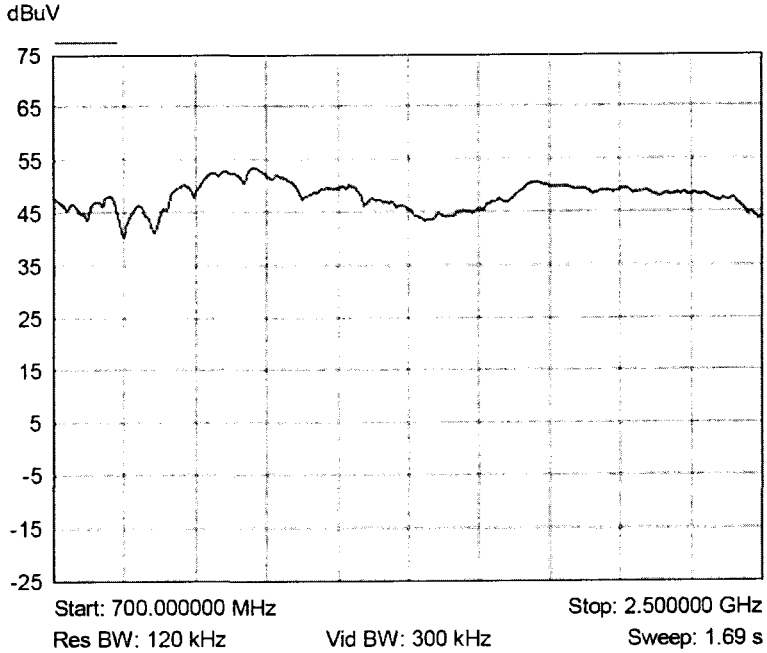

The first sheet of electrical conducting material 13 (third land) has a maximum y-dimension of about 11 cm and maximum x-dimension of about 11 cm. With the above configuration, the antenna has good gain in both boresight directions and defined by the Z axis (as shown in FIG. 1) for frequencies in the range of 700 MHz to 1.1 GHz. FIG. 3 depicts a frequency sweep for gain for both boresight directions. In particular, FIG. 3(*a*) is a boresight measurement corresponding to a −Z point of the Z axis, where FIG. 3(*b*) is a boresight measurement corresponding to that on a +Z point of the Z axis.

Whereas FIG. 3(*b*) illustrates that the antenna has good gain at the +Z boresight across a wide-bandwidth. FIG. 3(*a*) shows that there is also a gain boost (with respect to the +Z boresight) available in the 700 to 1100 MHz band at −Z boresight. Hence, the antenna permits both wideband gain in one boresight direction, but also provides a relative gain boost in the opposite boresight direction over a relatively narrower frequency band. The relative gain boost is about 10 dB at −Z boresight with respect to +Z boresight. This gain boost is found to be present for all spacings between sheet 13 and lands 1, 3, 5 and 7 in the range of about 9λ/100 to about 13λ/100 (which corresponds to about 2.97 cm and about 4.29 cm respectively).

Hence, the antenna offers two modes of operation in opposite boresight directions respectively. It can, dependent on the boresight direction, provide wither lower gain over a wider bandwidth, or higher gain over a narrower bandwidth.

With reference to FIG. 4, the antenna may also comprises a second electrically conductive sheet of material 21, i.e. a fourth land, that is in a third plane parallel to the first and second planes, but spaced apart from the lands 1, 3, 5 and 7 in the first plane. For operation in the range of 700 MHz to 1.1 GHz this separation may be between 9λ/100 and 13λ/100, and ideally about 3λ/25, where A is the wavelength of operation of the antenna. Thus, for a range centred on 900 MHz, the third and first planes are separated by between 3 cm and 4.3 cm and ideally 4 cm.

A centre 25 of the second electrically conductive sheet may be in register with a centre point 23 between the lands 1, 3, 5 and 7 on the first plane. The spacing may comprise an insulator to tune the frequency of operation, or other antenna characteristics.

The second sheet of electrical conducting material 21 has a maximum y-dimension of about 12 cm and a maximum x-dimension of about 12 cm. It is found that this gives a further gain boost of about 2 dB to that outlined above in the 700 to 1100 MHz band at −Z boresight to give rise to a total relative gain boost of about 12 dB at −Z boresight with respect to +Z boresight.

Alternatively, the second sheet of electrical conducting material 21 may have a maximum y-dimension of about 30 cm and a maximum x-dimension of about 30 cm. It is found that this gives an even further gain boost of about 5 dB, i.e. larger than that for the first aspect of the first variation to that outlined above in the 700 to 1100 MHz band at −Z boresight to give rise to a total relative gain boost of about 15 dB at −Z boresight with respect to the +Z boresight.

It will be appreciated that the third and/or fourth conducting lands, and/or at least one of the first pair and second single or pair of conducting lands may be connected to an antenna ground and/or a system ground. This can be used to add further gain boosts.

It will also be appreciated that shorting non-fed pair(s) of lands can improve band selectively, and this can be achieved by shorting across a small area of exposed foil on each land.

The antenna has been described above with reference to operating with frequencies ranges in the range of 700 MHz to 1.1 GHz. However, by altering the dimensions of the components of the antenna, while retaining the same configuration of components, the same antenna configuration can be optimised for receiving signals in the range of 470 MHz to 800 MHz, as for example typically used for transmission of terrestrial television signals.

In order to optimise the antenna for receiving signals in the range of 470 MHz to 800 MHz, with reference to FIG. 1, the spacing between each of the pairs of lands 1, 3 and 5, 7 respectively would need to be in the range of between 0.5 cm and 1.5 cm and ideally would be 1 cm, where the antenna is optimised for receiving signals centred on 600 MHz. The width of each of the lands 1, 3, 5 and 7 in the x-direction, as shown in FIG. 1, would then be between 7 cm and 9 cm and ideally would be 8 cm, making the overall width "A" of the antenna 17 cm, (between the opposed outer edges of the lands 1, 3 and 5, 7 respectively). Each of the lands 1, 3, 5 and 7 would then preferably have a maximum dimension in the y-direction of between 5.5 cm and 7.5 cm and ideally would have a height of 6.5 cm in the y-direction. The gap between pairs of lands 1, 5 and 3, 7 respectively would then be in the range of between 3 cm and 5 cm and ideally 4 cm giving an overall maximum dimension in the y-direction for the lands 1, 3, 5 and 7 in the plane 2 of 17 cm. The third and fourth lands would similarly be scaled up in size and the optimal dimension of the third land would be ??? cm by ??? cm and ??? cm by ??? cm respectively.

In a first environment, antenna 2 is preferably integrated in a consumer electronic device. Such a device with which the antenna can be integrated typically has a display panel, such as an LCD, LED, OLED, AMOLED, plasma, or the like, display panel. The panel of the display is typically electrically conductive and can thus serve as the first electrical conductive sheet 13 of the antenna 2. To further increase the effectiveness of the antenna 2, one of the feeds 17 can be electrically coupled to a ground connection of an electronic system of the consumer electronic device. Alternatively, the antenna may be integrated into a support bracket for a display or television.

Typically, the display panel is connected to this same ground connection of the electronic system of the consumer electronic device. Similarly, the skilled person would appreciate that the ground connection of the electronic system can be system ground, signal ground, circuit ground, chassis ground, or equivalent.

A housing of the consumer electronic device can also support the lands 1, 3, 5 and 7, which can be mounted inside or outside the housing, or be embedded therein to achieve any of the desired spacings of the lands 1, 3, 5 and 7 from the display panel (first electrical conductive surface 13).

In principle, antenna 2 can be integrated into any consumer electronics device in accordance with the principles disclosed herein.

In a second environment, antenna 2 is preferably integrated in an automobile component. Such an automobile component with which the antenna can be integrated typically is a wing mirror. The wing mirror housing and/or a backing of the mirror itself is typically metallic and can thus serve as the first electrical conductive sheet 13 of the antenna 2. The lands 1, 3, 5 and 7 can then be mounted within the wing mirror. Alternatively, the body (again typically metallic) of the automobile can serve as the first electrical conductive sheet 13 of the antenna. The lands 1, 3, 5 and 7 can then be mounted within the body. Alternatively, the car door outer panel (again typically metallic) of the automobile can serve as either the first electrical conductive sheet 13 or the second electrical conductive sheet 21 of the antenna. The lands 1, 3, 5 and 7 and the other of the first electrical conductive sheet 13 or the second electrical conductive sheet 21 of the antenna can then be mounted within the door. To further increase the effectiveness of the antenna 2, one of the feeds 17 can be electrically coupled to a ground connection of an electronic system of the automobile.

Any of the above arrangements could be used to provide cellular-based WAN access, and in particular the current 3G/4G MHz bands. Such 3G/4G MHz bands could be well served by the gain boost provided by the antenna 2 when in the presence of a weak cellular signal.

Further, an antenna system may be formed using two antennas 2 (i.e. any of the variants disclosed above). This allows multiple-input and multiple-output, MIMO, implementations to be used.

Although the lands are described as being formed by laminating aluminium foil lands by hot foil blocking onto stiff cardboard, it is possible to use lands in the form of thin electrically conductive materials such as aluminium manufactured to present as foil type lands. In addition the foil type lands can be manufactured from microwave materials by selecting a material with the appropriate properties such as dielectric constant, thickness and conductor type. Hence, use of the word foil is used to mean both lands formed from a foil and lands formed in other ways which present similarly in the form of foil type elements.

It will be appreciated that this description is by way of example only; alternations and modifications may be made to the described embodiment without departing from the scope of the invention as defined in the claims.

The invention claimed is:

1. An antenna comprising:

a pair of electrically conducting first lands disposed in a first plane, the pair of first lands being arranged to either side of, and spaced-apart from, an imaginary line on the first plane;

antenna feed means for the pair of first electrically conducting lands;

a pair of spaced-apart electrically conducting second lands or a single electrically conducting second land, disposed in said first plane, said pair of second lands or said single second land being spaced-apart from the pair of first lands along said imaginary line, being electrically-insulated from the pair of first lands, and the pair of second lands being arranged to either side of said imaginary line or the single second land extending across said imaginary line; and a third electrically conducting land oriented in a second plane substantially parallel to the first plane, wherein the first plane is spaced apart from the second plane by a value in the range of between 9 $\lambda/100$ and 13 $\lambda/100$ for an antenna operating frequency of between 700 MHz to 1100 MHz or in the range of 14 $\lambda/100$ to 18 $\lambda/100$ for an antenna operating frequency of between 470 MHz and 800 MHz, wherein $\lambda$ is the wavelength of operation of the antenna.

2. An antenna as claimed in claim 1, wherein:

the pair of first lands are arranged symmetrically about the imaginary line, and the pair of second lands are arranged symmetrically about said imaginary line or said single second land is symmetrical about said imaginary line.

3. The antenna of claim 1, wherein the antenna is configured to operate at frequencies between 700 MHz and 1.1 GHz, and the first plane is spaced from the second plane by a distance of between 3 cm and 4.3 cm.

4. The antenna of claim 3, wherein the first and second lands are arranged in a substantially rectangular configuration in the first plane with the imaginary line extending in a y-direction in the first plane, wherein a distance between outer edges of the pair of first lands in an x-direction in the first plane, perpendicular to the y-direction, is between 8 cm and 9 cm.

5. The antenna of claim 4, wherein a gap between the pair of first lands in the x-direction is between 0.5 cm and 1 cm.

6. The antenna of claim 4, wherein an overall distance between opposite outer edges of the pair of first lands and the pair of second lands, or between the first lands and the single second land, is between 8 cm and 10 cm in the y-direction.

7. The antenna of claim 6, wherein a gap between the first lands and the second lands, or between the first lands and the single second land, is between 1 cm and 3 cm in the y-direction.

8. The antenna of claim 1, wherein the antenna is intended to operate at frequencies between 470 MHz and 800 MHz, and the first plane is spaced from the second plane by between 6.9 cm and 8.8 cm, wherein the first and second lands are arranged in a substantially rectangular configuration in the first plane with the imaginary line extending in a y-direction in the first plane, and wherein the overall distance between the outer edges of the pair of first lands in an x-direction in the first plane, perpendicular to the y-direction is between 16 cm and 19 cm.

9. The antenna of claim 8, wherein a gap between the first lands in the x-direction is between 0.5 cm and 2 cm.

10. The antenna of claim 9, wherein an overall distance of the pair of lands and the pair of second lands, or between opposite outer edges of the pair of first lands and the single second land, is between 16 cm and 18 cm in the y-direction.

11. The antenna of claim 10, wherein a gap between the first lands and the second lands, or between the first lands and the single second land, is between 3 cm and 5 cm in the y-direction.

12. The antenna of claim 1, further comprising a fourth conducting land in a third plane substantially parallel to both the first plane and the second plane, wherein the third plane is offset from both first plane and the second plane, with the first plane located between the third and second planes.

13. The antenna of claim 12, where the third plane is spaced apart from the first plane by a distance substantially equal to a distance by which the first plane is spaced from the second plane.

14. The antenna of claim 12, wherein the third and/or fourth conducting land comprises an electrically conducting panel of a device or of an object in which the antenna is mounted.

15. The antenna of claim 14, wherein the electrically conducting panel is a body part or a panel of an automobile.

16. The antenna of claim 15, wherein the body part is part of a wing mirror, wherein an outer surface or a backing of a mirror of the wing mirror serves as the third land, and wherein the first and second lands are mounted within the wing mirror.

17. The antenna of claim 15, wherein the body part comprises a door, wherein an outer surface of the door serves as the third land, and wherein the first and second lands are mounted within the door.

18. The antenna of claim 12, wherein the third and/or fourth lands, and/or at least one of the first lands and/or the second land, is connected to an antenna ground and/or a system ground.

19. The antenna of claim 1, comprising a pair of second lands, wherein each land of the first and second lands is substantially the same size and shape, or have shapes which are mirror images of one another.

20. The antenna of claim 1, comprising a pair of second lands, wherein each land of the first and second lands is of a size and shape and has a spacing with respect to the other lands so as to permit resonance at the antenna operating frequency.

* * * * *